US005165639A

United States Patent [19]

Knuppe

[11] Patent Number: 5,165,639

[45] Date of Patent: Nov. 24, 1992

[54] VESSEL SUPPORT

[76] Inventor: Michael Knuppe, 4545 Crow Canyon Pl., Castro Valley, Calif. 94552

[21] Appl. No.: 695,734

[22] Filed: May 6, 1991

[51] Int. Cl.[5] ..... A47K 1/00

[52] U.S. Cl. ..... 248/215; 248/311.2; 248/912; 248/300

[58] Field of Search ..... 248/311.2, 911, 912, 248/315, 318, 300, 301, 211, 210, 215, 206.1, 150; 297/194, 191

[56] References Cited

U.S. PATENT DOCUMENTS

| | | | |
|---|---|---|---|
| 546,081 | 9/1895 | Reyer | 248/911 X |
| 1,178,965 | 4/1916 | Stroecker | 248/210 |
| 1,343,363 | 6/1920 | Hall | 248/315 X |
| 2,628,054 | 2/1953 | Fazakerley | 248/311.2 |
| 2,686,032 | 8/1954 | Thorson | 248/211 |
| 2,807,315 | 9/1957 | Manne | 297/191 |
| 3,117,673 | 1/1964 | Hatfield et al. | 248/315 X |
| 3,128,984 | 4/1964 | Palm | 248/311.2 |
| 3,990,654 | 11/1976 | Michael | 248/311.2 |
| 4,560,127 | 12/1985 | Ippolito | 248/210 |
| 4,887,784 | 12/1989 | Kayali | 248/311.2 |

FOREIGN PATENT DOCUMENTS

| | | | |
|---|---|---|---|
| 847337 | 6/1952 | Fed. Rep. of Germany | 248/311.2 |

*Primary Examiner*—Karen J. Chotkowski
*Attorney, Agent, or Firm*—Theodore J. Bielen, Jr.

[57] ABSTRACT

A mounting device for positioning a liquid or solid containing vessel relative to first and second bodies, such as adjacent stadium seats, utilizing a holder having an opening for at least partially surrounding the vessel. The holder further includes a flange which extends outwardly from the opening and possesses first and second surfaces for contacting the first and second bodies. A hanging element is formed with an element for engaging a structural member spanning the first and second bodies and includes an end portion which engages and removably connects to the holder.

10 Claims, 1 Drawing Sheet

VESSEL SUPPORT

BACKGROUND OF THE INVENTION

The present invention relates to a mounting device for positioning a liquid or solid containing vessel relative to first and second bodies.

Arenas and stadiums used for entertainment and sporting events normally seat tens of thousands of people at one time. Consumption of food or beverages by fans or members of an audience is particularly common. Unfortunately, convenient packaging of food items, such as beverages, in cans or bottles has been banned in most arenas, theaters, and stadiums, since those items are capable of being hurled at the participants and other fans. As a substitute for hard containers, drinks are most commonly served in soft open cups without removable circular sealing tops, the latter being an object possessing undesirable aerodynamic characteristics.

Unfortunately, open cups are very difficult to maintain in an upright position in the tight seating arrangements found in most arenas, stadiums and the like. The movement of persons in and out of rows of seats, moments of excitement during the game or event, and similar circumstances all tend to spill the contents of a portable vessel.

Paper or plastic cup toting trays have been devised in the past, but such trays are very difficult to position and must constantly be moved during the multitude of activities taking place at the game or event. Platforms found between rows offer little room for these trays. In addition, such vessel holding trays create a disposal problem since they are not intended for reuse. Any vessel holders temporarily or permanently affixed to arm rests and seat backs are inconvenient and encroach on seating space.

A mounting device for a drink containing vessel used in a stadium, theater or arena would be notable advance in the handling of consumable items, such as beverages.

SUMMARY OF THE INVENTION

In accordance with the present invention a novel and useful mounting device for positioning a vessel to first and second bodies such as stadium seats, is herein provided.

The mounting device of the present invention employs a holder having an opening for at least partially surrounding the drink containing vessel. The opening may be in the form of a depression or a fully cut-out portion in the holder. The holder also includes a flange which extends outwardly from the opening and includes first and second surfaces for contacting the first and second bodies, respectively. The first and second surfaces of the flange may take the form of a pair of feet having a slot therebetween. The holder may be formed of relatively rigid or semi-rigid material which is not susceptible to structural deterioration under the influence of moisture.

The mounting device of the present invention also includes a element having a first end portion, a second end portion, and a intermediate portion between the first and second end portions. The first end portion may include means for engaging the structural member located between the first and second bodies. Such means may take the form of a hook, clip, cap or other like configuration. The second end portion possesses means for connecting the holder to the element. Such connecting means may be in the format of a slot formed in the second portion of the element which interlocks with the slot found between the first and second surfaces of the flange of the holder. The element slot and the holder slot are removably engagable. Consequently, the weight of liquid in the vessel being found in the holder will rotate the holder and element combination toward the first and second bodies. Such rotation takes place around the structural member located between the first and second bodies.

The present invention also includes a tab having an opening for at least partially surrounding the vessel. Such opening has a smaller transverse dimension than the opening of the holder to accommodate smaller sized vessels. The tab also include means for connecting the same to the element. In such a case, the connecting means may take the form of a slot which frictionally engages the element. Such frictional engagement permits the tab to rotate to a position adjacent the intermediate portion of the element to a position which overlies the holder. A second slot is capable of engaging the element to maintain the tab adjacent the intermediate portion of the element to permit usage of the holder opening.

It may be apparent that a novel and useful mounting device for positioning a vessel relative to a structural member between first and second bodies has been described.

It is therefore an object of the present invention to provide a mounting device which is usable for holding vessels containing liquids in a mass seating structure, such as a stadium or theatre.

It is another object of the present invention to provide a mounting device for positioning a vessel which is easily assembled and subsequently collapsed for use and storage, respectively.

Another object of the present invention is to provide a mounting device for positioning a vessel which includes the ability to adjust to the size of the vessel.

Yet another object of the present invention is to provide a mounting device for positioning a vessel in a stadium which prevents accidental spillage of the contents of the vessel.

Another object of the present invention is to provide a mounting device for positioning a vessel on the rear portion of a row of seats of different configurations by interchanging portions of the mounting device as required.

The invention possesses other objects and advantages especially as concerns particular characteristics and features thereof which will become apparent as the specification continues.

For a better understanding of the invention reference is made to the following detail description of the preferred embodiments thereof which should be referenced to the hereinabove described drawings.

DESCRIPTION OF THE PREFERRED EMBODIMENTS

Various aspects of the present invention will evolve from the following detailed description of the preferred embodiments thereof which should be taken in conjunction with the prior described drawings.

Figure 2:
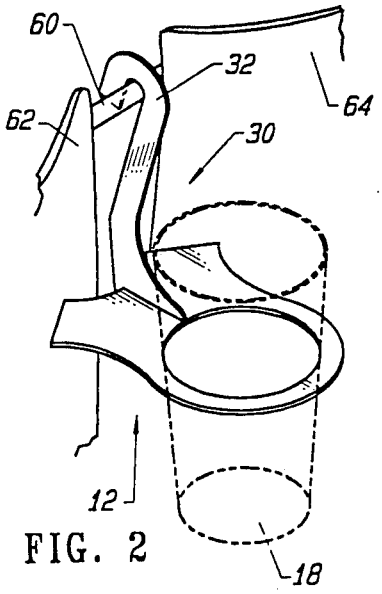
FIG. 2 is a top plan view of the holder portion of the mounting device of the present invention.

The invention as a whole is shown in the drawings by reference character 10. Mounting device 10 includes a holder 12, FIG. 2, having an annular ring 14 forming a central opening 16. Central opening 16 is sized to hold a vessel, such as vessel 18 FIG. 4, which normally contains items such as liquid drinks, popcorn, frozen confectioneries, and the like. Vessel 18 is generally in the shape of a truncated cone, but device 10 is not limited to use with a vessel of this shape. Holder 12 is further constructed with a flange portion 20 terminating in feet 22 and 24. End surfaces 26 and 28 form the terminus of feet 22 and 24, respectively.

Figure 1:
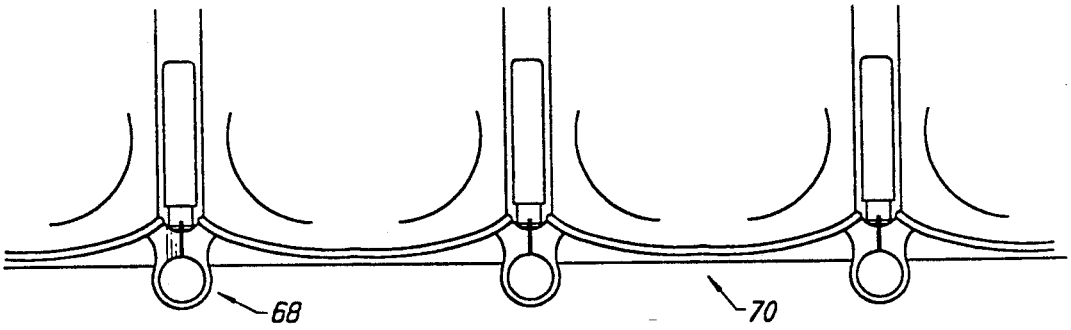
FIG. 1 is a side elevational view of the mounting device of the present invention depicting the vessel size adjusting tab movement in phantom.
Figure 4:
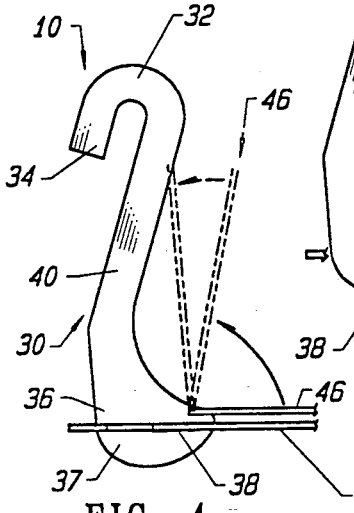
FIG. 4 is a side elevational view of the mounting device of the present invention depicting the structural support member in section and a vessel in phantom.
Figure 3:
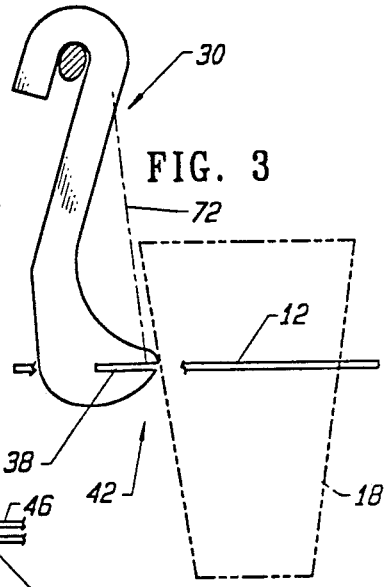
FIG. 3 is a top plan view of the tab portion of the mounting device of the present invention.

Mounting device 10 also includes an element 30, FIGS. 1 and 4, which includes a first portion 32 having a loop or hook 34. It should be realized that other connecting items may be employed in substitution for hook 34, such as a cap, a magnet, a serrated body, an adhesive, and the like. In this regard element 30 having a different dimension and first portion may be easily substituted for use with holder 12 depending on the particular environment of use, which will be discussed hereinafter. Element 30 also possesses a second portion 36 having a horizontal slot 38 which extends partially through second portion 36. Angled intermediate portion 40 of element 30 connects first portion 32 to second portion 36.

Means 42 is also included in the present invention for connecting holder 12 to element 30. Means 42 may take the form of a slot 44 located between legs 20 and 24 of holder 12 and slot 38 of second portion 36 of element 30. Slots 44 and 38 are sized such that support 12 is slidable along slot 44 relative second portion 36 of element 30. Likewise, slot 38 slides along flange 20 of support 12. Thus, slots 38 and 44 interlock holder 12 and element 30, as shown in FIGS. 1 and 4. Fin 37 founded below connected holder 12 adds to the stability and strength of mounting device 10.

Tab 46 may also be employed with mounting device. Tab 46 includes a flat ring body 48 having a pair of alternate slots 50 and 52. With reference to FIG. 1, it may be observed that slot 50 or 52 slides over the end surface 54 of element 30 such that tab 46 lies atop the ring portion 14 of holder 12. In addition, tab 46 may be rotated upwardly, FIG. 1, to reveal and render accessible opening 16 of holder 12. Either slot 50 or 52 may be employed to hold tab 46 to edge surface 54 of element 30. In other words, edge surface 54 frictionally fits within slot 50 or 52 of tab 46. The central opening 56 of tab 46 possesses a lesser transverse dimension than opening 16 of holder 12. Thus, opening 56 of ring body 48 may hold a drink vessel such as vessel 58 of FIG. 6, which is smaller than vessel 18, FIGS. 4 and 5.

Figure 7:
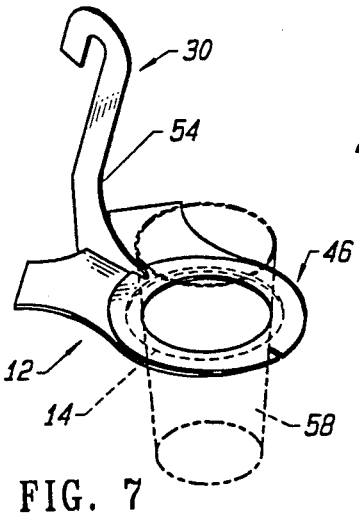
FIG. 7 is a top plan view of a plurality of mounting devices shown in place between stadium seats.
Figure 5:
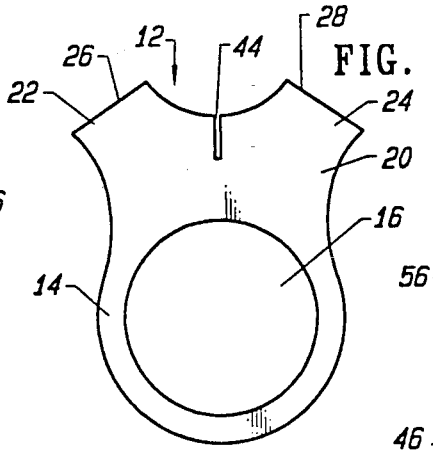
FIG. 5 is a top, right, rear perspective view of the mounting device of the present invention in place with a relatively large vessel shown in phantom.
Figure 6:
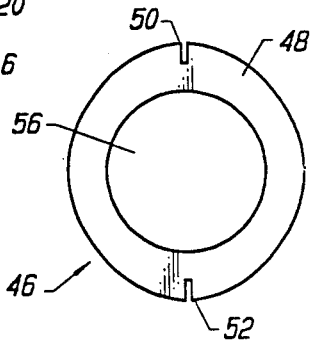
FIG. 6 is a top, rear, right perspective view of the device of the present invention utilizing the tab portion to hold a relatively small vessel, shown in phantom.

In operation, holder 12 and element 30 are assembled to the configurations shown in FIGS. 5 and 6. FIG. 6 depicts the use of tab 46 in conjunction with structural member 60. With reference to FIG. 5, holder 12 is able to hold a relatively large vessel 18. In contrast, FIG. 6 depicts the use of tab 46 where a smaller vessel 58 is being supported by mounting device 10. Tab 46 may be rotated out of a superimposed configuration relative to holder 12 and into a raised position. While in the latter position tab 46 may be held to element 30 by the frictional engagement of slot 50 or 52 with edge 54 of element 30. The angled shape of intermediate portion 40 of element 30 allows tab 46 to lie in a non-interfering position relative to large vessel 18, generally along axis 72, FIG. 4. Loop 32 hooks onto structural member 60 which is found in various configurations between bodies 62 and 64, representing the back of stadium seats possessing a convex curvature. For example, structural member 60 may be formed as a vertical post an extension of plurality of seats 66, and the like. Turning to FIG. 7, it may be observed that plurality of stadium seats 66 are able to support plurality of mounting devices 68, each possessing the structure of mounting device 10. It should be noted, that the drinks found in each holder, such as holder 12, of plurality of mounting devices 68 are slightly recessed from platform 70 which also serves as a walkway of persons occupying the seats in a row behind plurality of seats 66. Thus, vessels, such as vessels 18 and 58 are greatly protected from movement in and out of plurality of seats 66. In addition the persons sitting directly behind plurality of seats 66 and similar seats (not shown) extend their legs through the left or right of plurality mounting devices 68, again obviating contact between the persons and vessels 18 or 58. The distance between first portion 32 and second portion 36 of element 30 may be predetermined by the particular distance relationships between structural member 60 and platform 70. Holder 12 and element 30 may be easily disassembled after use and conveniently transported in a clothing pocket.

While in foregoing, embodiments of the invention have been set forth in considerable detail for the purposes of making a complete disclosure of the invention, it may be apparent to those of skill in the art that numerous changes may be made in such details without departing from the spirit and principles of the invention.

What is claimed is

1. A mounting device for positioning a vessel relative to a structural member located between first and second bodies, comprising:

a. a holder having an opening for at least partially surrounding the vessel, said holder further including a flange extending outwardly from said opening, said flange including a first surface for contacting the first body and a second surface for contacting the second body;

b. an element including a first end portion, said first end portion being formed with means for engaging the structural member located between the first and second bodies, said element further including a second end portion and an intermediate portion between said first and second end portions; and c. means for removably connecting said holder to said element including a first slot formed at said second end portion of said element and a second slot formed at said flange of said holder, said first and second slots being capable of interlocking engagement.

2. The device of claim 1 in which said first slot of said holder lies between said flange first and second edge portions.

3. The device of claim 1 in which said opening of said holder extends through said holder.

4. The device of claim 1 which additionally comprises a tab having an opening for at least partially surrounding the vessel, said device further including means for connecting said tab to said element, said tab opening having a transverse dimension of said holder opening.

5. The device of claim 4 which additionally comprises means for rotating said tab from a position adjacent said intermediate portion of said element into overlying relationship with said holder.

6. The device of claim 4 in which said means for connecting said tab to said element includes a slot formed in said tab, said tab slot frictionally engaging said element.

7. The device of claim 4 in which said means for connecting said tab to said element includes a pair of slots each being capable of frictionally engaging said element.

8. The device of claim 7 in which said intermediate portion of said element extends outwardly from said place of connection of said holder, relative to the structural member.

9. The device of claim 1 in which said means for engaging the structural member located between the first and second bodies includes a loop formed at said first end portion of said element.

10. The device of claim 1 in which said holder and said element are flat in cross-sectional configuration.

* * * * *